US006467123B1

(12) United States Patent
Di Nunzio et al.

(10) Patent No.: US 6,467,123 B1
(45) Date of Patent: Oct. 22, 2002

(54) AIRFLOW INDICATOR

(75) Inventors: David Di Nunzio, Mentor; Paul D. Stephens, Cleveland Heights; Charles Thur, Mentor; Michael F. Wright, Stow; Victor R. Younger, Parma, all of OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 0 days.

(21) Appl. No.: 09/590,088

(22) Filed: Jun. 7, 2000

(51) Int. Cl.[7] ..... A47L 9/00
(52) U.S. Cl. ..... 15/339; 15/347
(58) Field of Search ..... 15/339, 347; 137/849, 137/845

(56) References Cited

U.S. PATENT DOCUMENTS

| | | | | | |
|---|---|---|---|---|---|
| 2,184,421 | A | | 12/1939 | Gerber | 16/266 |
| 2,353,621 | A | * | 7/1944 | Replogle | 15/339 |
| 2,908,283 | A | * | 10/1959 | Kiffer et al. | 137/849 |
| 3,253,295 | A | * | 5/1966 | Waters | 15/339 |
| 3,279,418 | A | | 10/1966 | Nilsson | 116/70 |
| RE26,235 | E | * | 7/1967 | Woodford | 137/849 |
| 3,333,564 | A | | 8/1967 | Waters | 116/268 |
| 3,587,515 | A | * | 6/1971 | Anderson | 15/339 |
| 3,678,882 | A | | 7/1972 | Kinsella | 116/268 |
| 3,766,595 | A | | 10/1973 | Valbona et al. | 15/339 |
| RE28,268 | E | | 12/1974 | Autrand | 116/67 R |
| 3,936,904 | A | | 2/1976 | Bashark | 15/339 |
| 4,015,308 | A | * | 4/1977 | Rickmers | 15/339 |
| 4,020,525 | A | | 5/1977 | Fromknecht et al. | 15/339 |
| 4,124,916 | A | | 11/1978 | Fromknecht | 15/339 |
| 4,294,595 | A | | 10/1981 | Bowerman | 96/403 |
| 4,733,430 | A | | 3/1988 | Westergren | 15/339 |
| 4,833,753 | A | * | 5/1989 | Müller | 15/339 |
| 4,991,745 | A | | 2/1991 | Brown | 222/212 |
| 5,033,655 | A | | 7/1991 | Brown | 222/212 |
| 5,213,236 | A | | 5/1993 | Brown et al. | 222/212 |
| 5,339,995 | A | | 8/1994 | Brown et al. | 222/173 |
| 5,377,877 | A | | 1/1995 | Brown et al. | 222/105 |
| 5,396,925 | A | * | 3/1995 | Poli | 137/845 |
| 5,409,144 | A | | 4/1995 | Brown | 222/185.1 |
| 5,439,143 | A | | 8/1995 | Brown et al. | 222/185.1 |
| 5,453,097 | A | * | 9/1995 | Paradis | 137/849 |

* cited by examiner

*Primary Examiner*—Theresa T. Snider
(74) *Attorney, Agent, or Firm*—Fay, Sharpe, Fagan, Minnich & McKee, LLP

(57) ABSTRACT

An airflow indicator for a vacuum cleaner includes a housing, a wheel chamber defined in the housing, and a rotatable wheel mounted in the wheel chamber. The wheel has protrusions which cause the wheel to rotate due to inlet air flow. The wheel further has markings which gradually increase in size along an outside perimeter of the wheel. The markings indicate movement of the wheel. An air inlet is formed adjacent a first end of the housing. An air passageway is formed within the housing adjacent the rotatable wheel and the air inlet. The air passageway is curved to facilitate air flow along the protrusions of the wheel. A valve is mounted within the housing adjacent the air passageway. The valve has a cross slit which opens in response to a change in vacuum pressure. An air outlet is formed in the housing. A window portion partially encloses the wheel within the wheel chamber. The window allows viewing of the wheel from outside of the housing.

19 Claims, 5 Drawing Sheets

AIRFLOW INDICATOR

BACKGROUND OF THE INVENTION

The present invention relates to an airflow indicator. More particularly, it relates to an airflow indicator for cooling a motor in a vacuum cleaner.

Typical vacuum cleaners load a suction motor more and more as the dirt bag/cup/container becomes full. Many vacuum systems use the air flow through the system in order to cool the motor (particularly in clean air type vacuums). As the dirt holding means of the vacuum becomes more and more full, there is less and less cooling air passing through the motor. The end result can be a reduced motor life due to increased loading. One attempt at remedying this problem is the use of a hold-open thermostat which shuts the unit off when the system airflow is not adequate to cool the motor.

The hold-open thermostat is used to prevent the motor from driving a brush roll of the vacuum cleaner once the motor has cooled down. A brush roll that engages when the cleaner is stationary is a safety hazard for an unsuspecting consumer evaluating the unit after it has shut off.

There are several reasons that the hold-open thermostat is not a good solution. Once the unit heats up to the trigger point, the consumer can no longer finish cleaning the carpet/surface. The fact that the unit will shut off and remain off for a period of thirty minutes or more is a big inconvenience to the consumer and therefore a product return issue as well.

Other vacuum systems have employed a bleed valve that opens an additional air path to the motor once the air flow through the motor is reduced to a certain level. The reduced (specified) level of airflow corresponds to a vacuum pressure value located at the bleed valve location. After some testing, a pressure value for the desired opening pressure is determined. Hence, a spring loaded valve is then designed to open once the pressure reaches the target value. Currently, vacuum system bleed valves employ a wire form spring. The wire form spring is part of an assembly which has a plunger that usually floats on the top end of the spring. The plunger also interfaces with another surface and commonly creates a seal based on the force of the compressed wire form spring.

Other vacuum manufacturers have used valves to indicate airflow to the consumer. Often this is done by displacement of a part once a certain pressure is achieved. Some vacuums have used a pin which displaces with the valve head once the open pressure is achieved. For instance, the pin displaces indicating that the final filter (often now a HEPA filter) may need replacement on the vacuum.

Although it is not exactly a valve, a full bag indicator has a plunger that moves in front of a clear window where it can be observed by the consumer. This change in position of the plunger is due to a pressure difference. The travel of the plunger is due to a small air hole which allows the plunger to move in the direction of the airflow. Since the airflow is so small, one can argue that the plunger operates on a static pressure difference.

Air valve springs often have low spring rates and large displacements once the desired opening pressure is reached. A larger spring rate usually translates to a system that is more sensitive to variations in assembly and manufacturing methods. Even though most air valves are designed with low spring rates, there are many inherent difficulties in achieving a system that performs accurately and precisely. The wire form spring design approach has many challenges. Often times, variations in plastic part dimensions prevent consistent compression. Variations in the wire form manufacture are costly to minimize and often require the use of precision springs. Even then, the variations expected with regard to the performance of an air valve are large. Often times, the displacement of the valve is different from valve to valve, and this can result in different airflow rates into the bleed valve. In fact, many air valve manufacturers actually inspect 100% of all of the assemblies that they ship.

Finally, once the air valve opens, it is often difficult to have the valve close at a desired pressure that is different than the opening value and ideal for customer use. The bleed valve will open under the sealed suction condition, and this often occurs intermittently when the consumer is cleaning furniture or using hand tools with the vacuum. Hence, it is desirable to have the valve close back up unless the filter needs cleaning. Again, it is very difficult to try to control the close value of a valve system that uses a wire form spring. Sometimes the valve will remain open due to the airflow through the valve. Finally, it is clear that friction is always a factor in a system that relies on surface-to-surface travel or displacement.

Accordingly, it has been considered desirable to develop a new and improved airflow indicator which would overcome the foregoing difficulties and others while producing better and more advantageous overall results.

SUMMARY OF THE INVENTION

The present invention relates to an airflow indicator. More particularly, it relates to an improved airflow indicator which provides additional air flow to cool off a motor of a suction device, such as a vacuum cleaner.

In the first preferred embodiment, an airflow indicator for a vacuum cleaner comprises a housing with a first end and a second end. The housing is comprised of a first section and a second section. The housing is fabricated from a plastic material. The housing can further comprises a pair of mounting holes for mounting the valve within the vacuum cleaner.

A wheel chamber is defined in the housing. A rotatable wheel is mounted in the wheel chamber at the housing first end. The wheel has protrusions which cause the wheel to rotate due to inlet air flow.

The wheel further comprises markings which gradually increase in size along an outside perimeter of the wheel. The markings indicate movement of the wheel.

An air inlet is formed at the first end of the housing. An air passageway is formed within the housing adjacent the rotatable wheel and the air inlet. An air outlet is formed at the second end of the housing.

A valve is mounted within the housing adjacent the air passageway. The valve comprises a cross slit which opens in response to a change in vacuum pressure. The cross slit remains closed at a pressure difference less than 56 inches of $H_2O$.

If preferred, the valve is fabricated from a silicon composite.

If desired, the airflow indicator further comprises a window portion which partially encloses the wheel within the wheel chamber. The window allows viewing of the wheel from outside of the housing.

The air passageway comprises a curved passageway within the housing to facilitate air flow along the protrusions of the wheel.

One advantage of the present invention is the provision of a new and improved airflow indicator for a home appliance, such as a vacuum cleaner.

Another advantage of the present invention is the provision of an airflow indicator having a rotatable wheel with protrusions mounted in a wheel chamber of a housing of the airflow indicator where airflow contacts the protrusions of the wheel causing the wheel to rotate.

Yet another advantage of the present invention is the provision of an airflow indicator having a window in the wheel chamber and a wheel with markings where the markings increase from smaller to larger sizes and are visible through the window to indicate movement of the wheel to the consumer.

Still another advantage of the present invention is the provision of an airflow indicator having a curved air passageway found within the housing to facilitate airflow along the protrusions of the wheel.

Still yet another advantage of the present invention is the provision of an airflow indicator having a valve mounted within the housing. The valve is made from a resilient material and includes cross slits which open in response to a change in vacuum pressure.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENTS

Figure 1:
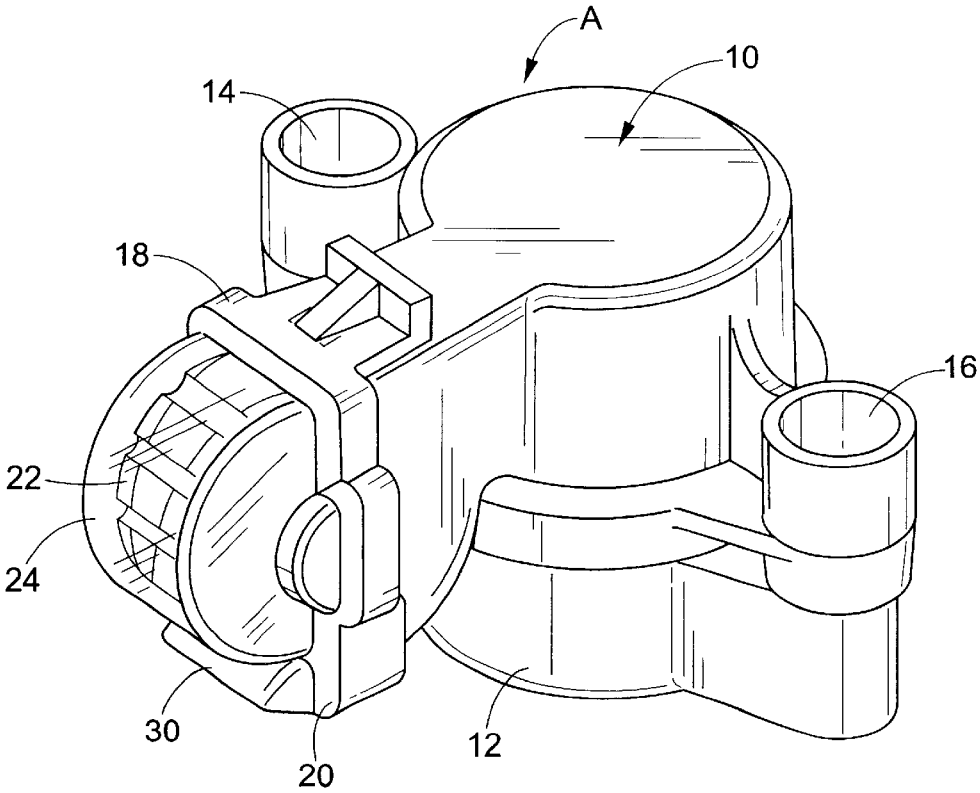
FIG. 1 is a perspective view of the airflow indicator in accordance with the preferred embodiment of the present invention.

Referring now to the drawings, wherein the showings are for purposes of illustrating a preferred embodiment of this invention only and not for purposes of limiting same, FIG. 1 shows a airflow indicator A according to the preferred embodiment of the present invention.

Figure 3:
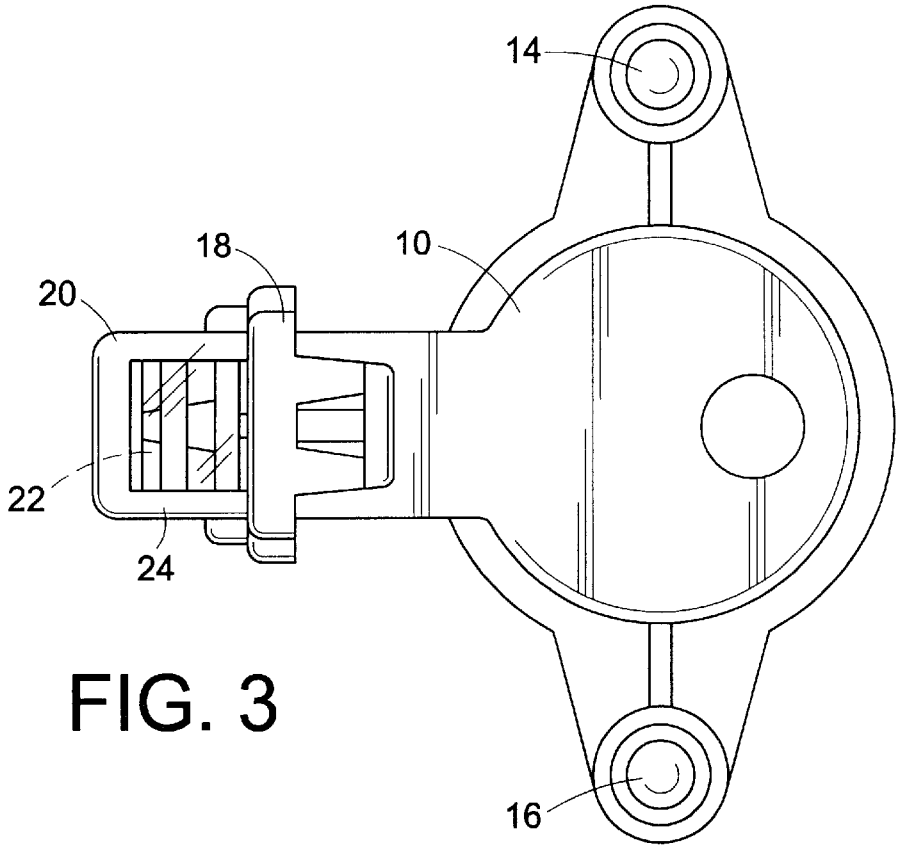
FIG. 3 is a top plan view of the airflow indicator of FIG. 1.

The airflow indicator A includes an upper housing section 10 and a lower housing section 12 connected to the upper housing section 10. Mounting holes 14, 16 (best seen in FIG. 3) are located on opposite lateral sides of the housing to secure the upper housing section 10 to the lower section housing 12. A wheel chamber 18 is defined in the housing at a first axial end 20 of the housing. A wheel 22 is rotatably mounted in the wheel chamber 18. Preferably, the housing sections 10, 12 and the wheel 22 are fabricated from plastic material.

Figure 4:
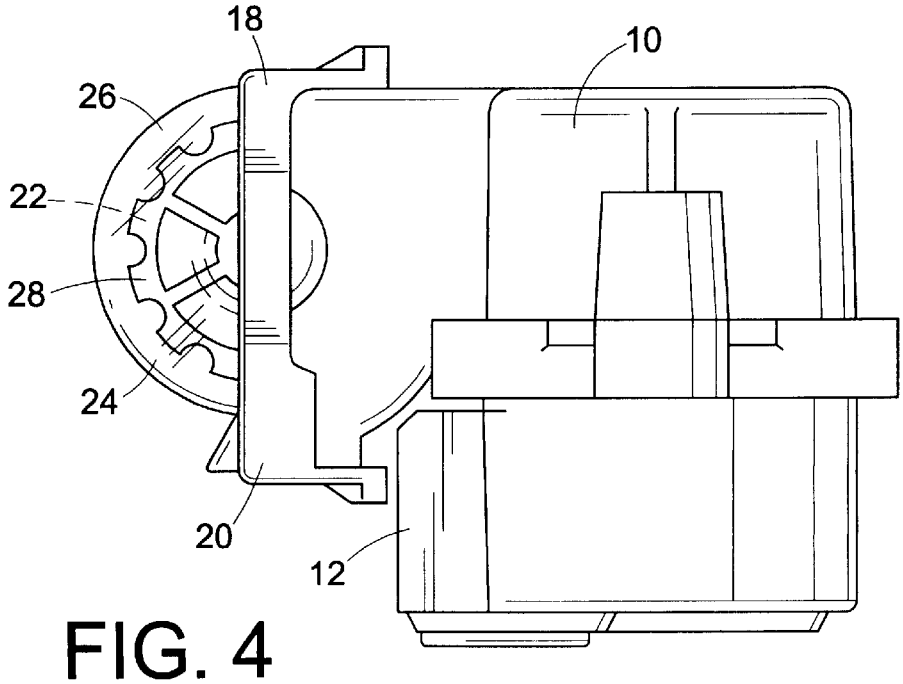
FIG. 4 is a side elevational view of the airflow indicator of FIG. 1.

A window portion 24 partially encloses the wheel 22 within the wheel chamber 18. The window 24 can be made of a conventional clear plastic. The window 24 allows viewing of the wheel 22 from outside of the housing. Referring to FIG. 4, the wheel 22 is circumferentially spaced from the interior of the wheel chamber 18 by an annular space 26. The annular space 26 between the window 24 and the wheel 22 is minimized to prevent air flow traveling along the wheel in a clockwise direction. The wheel 22 has protrusions 28 along its perimeter which cause the wheel to rotate due to air suction.

Figure 5:
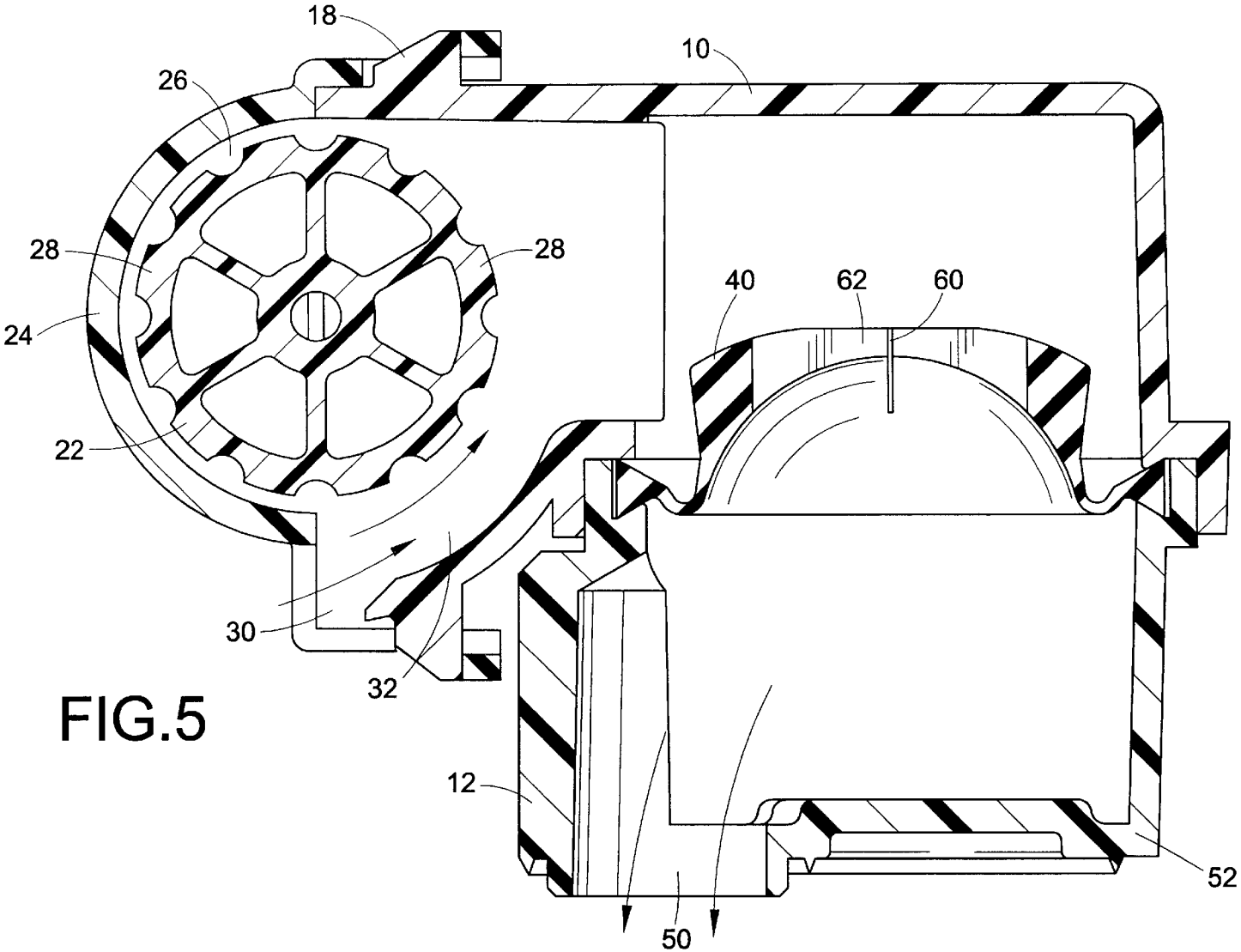
FIG. 5 is an enlarged side elevational view, in cross section, of the airflow indicator of FIG. 1, illustrating a wheel and a valve within the indicator.

Referring to FIG. 5, an air inlet 30 is formed adjacent the first end 20 of the housing adjacent the window 24. An air passageway 32 is formed within the housing adjacent the rotatable wheel 22 and the air inlet 30. A bleed valve 40 is mounted within the housing adjacent the air passageway 32. An air outlet 50 is formed adjacent a second end 52 of the housing.

To determine the change in air pressure that will be seen by the valve 40, an orifice plate restriction was placed at an inlet of a tube (not illustrated) within the vacuum cleaner. The orifice plate restricted the inlet which allowed the system to experience pressure changes that occur when a filter bag or dust cup of the vacuum cleaner becomes full or a filter becomes clogged. The orifice plate restricted airflow to the filter. A pressure tap (not illustrated) was positioned where the airflow indicator would be located; i.e., in an air channel behind the filter and either above or below the dust container or bag. The pressure tap measured the pressure value (approximately 56 inches of $H_2O$) that would be experienced by the bleed valve.

The vacuum cleaner includes a conventional suction motor and fan assembly (not shown) for creating a vacuum or suction pressure. The air outlet opening 50 exhausts into the vacuum bag compartment (not shown). Thus, when the motor/fan assembly is operating, virtually no atmospheric air enters through the air inlet 30 into the wheel chamber 1. When the vacuum cleaner is turned on, assuming that the vacuum bag thereof is empty or not overfilled, the air coming into the wheel chamber 18 through the air inlet 30 is insufficient to rotate the wheel in the counterclockwise direction. However, once the valve experiences a certain pressure value as determined by the pressure tap, i.e., approximately 56 inches of $H_2O$, then the valve opens, causing air to enter the air inlet 30. The incoming air is directed into a counterclockwise direction by the curved passageway 32 of the air inlet 30. Thus, the incoming air moves past the protrusions 28 of the wheel 22 causing the protrusions to rotate in a counterclockwise direction thus causing the rotation of the wheel in a counterclockwise direction.

Figure 2:
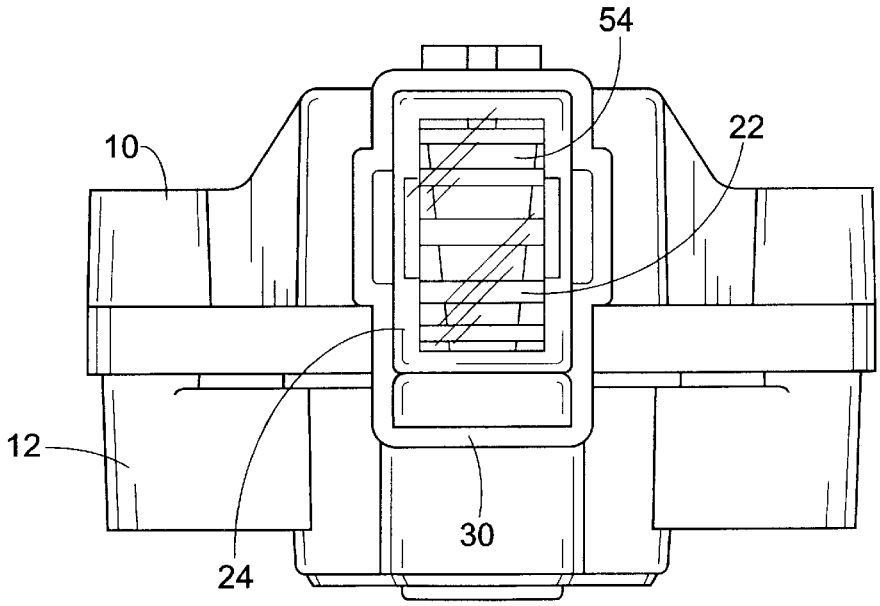
FIG. 2 is a front elevational view of the airflow indicator of FIG. 1.

Referring to FIG. 2, the wheel 22 has a series of markers 54 formed on the outer surface of the wheel. When the vacuum cleaner filter becomes clogged or the vacuum bag becomes filled, the suction pressure inside the vacuum bag chamber is appreciably increased. This change in pressure differential between the inside of the vacuum cleaner and the atmosphere results in an increased rush of air into the wheel chamber 18. This increased rush of air or increase in pressure differential results in the wheel protrusions 28 rotating counterclockwise, thus rotating the wheel 22 counterclockwise to move the markers 54 from the smallest marker to the largest marker past the window 24. The motion of the wheel 22 is easy to detect because the markers are continually moving past the window. Thus, the wheel 22 serves as a dynamic performance indicator. The movement of the wheel 22 underneath the window 24 tells the user to check the vacuum cleaner for obstructions in the air flow path thereof including the dust cup, inlet filter, or fill condition of the vacuum bag.

By changing the appearance of the wheel 22 across 360 degrees of the perimeter, a consumer can easily perceive the motion of the wheel. That motion can be used to indicate a full dirt bag, dirty inlet filter, dirty final filter (via use of positive pressure instead of vacuum pressure), a clog, or perhaps even a broken belt (based on positioning and pressure differences).

If desired, the bleed valve can be fabricated from a conventional thermoplastic resilient material. In one embodiment, the valve is fabricated from a silicon composite, including silicon-polymeric composites, such as a silicone rubber. The use of a silicon composite bleed valve, available from Liquid Molding Systems, Inc. of 800 South Jefferson Avenue, Midland, Mich. 48640-5386, is common in liquid applications. The bleed valve is the subject of the following Liquid Molding Systems, Inc. patents: U.S. Pat. Nos. 5,439,143; 5,409,144; 5,377,877; 5,339,995; 5,213,236; 5,033,655; and 4,991,745. The bleed valve 40 is designed for air flow application. It should be appreciated that the bleed valve 40 could be made from other conventional resilient materials, if so desired.

Figure 6:
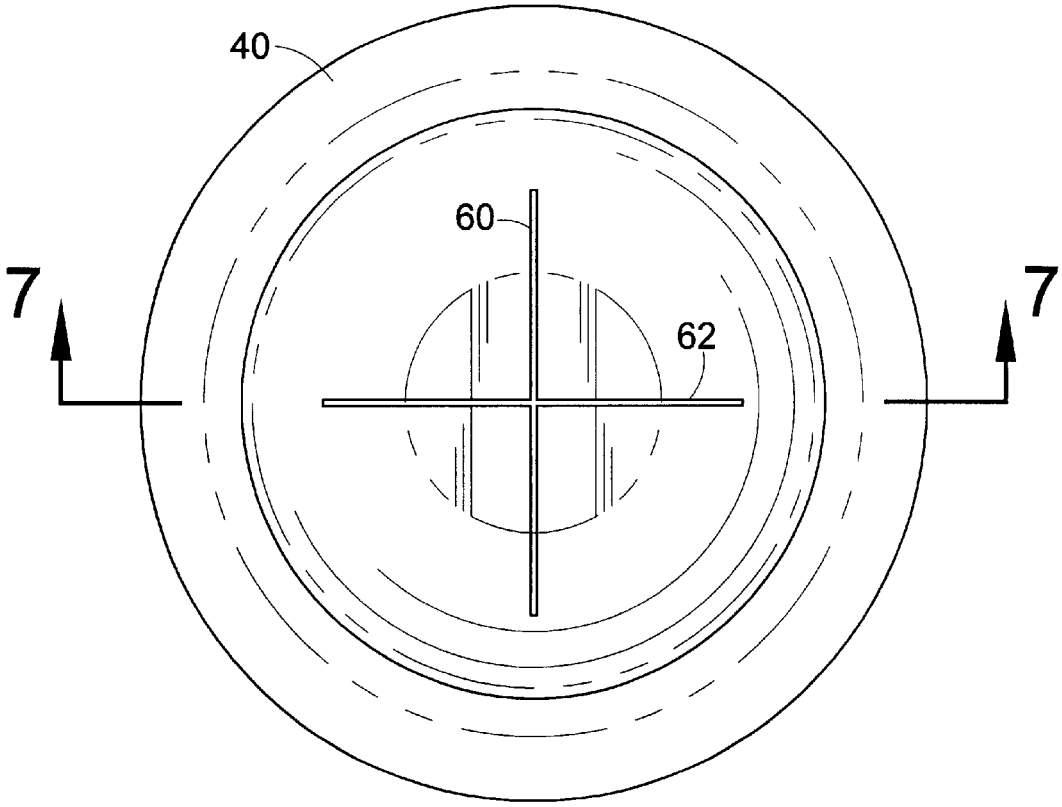
FIG. 6 is an enlarged top plan view of the valve of the airflow indicator of FIG. 5, illustrating a cross slit in the valve.
Figure 7:
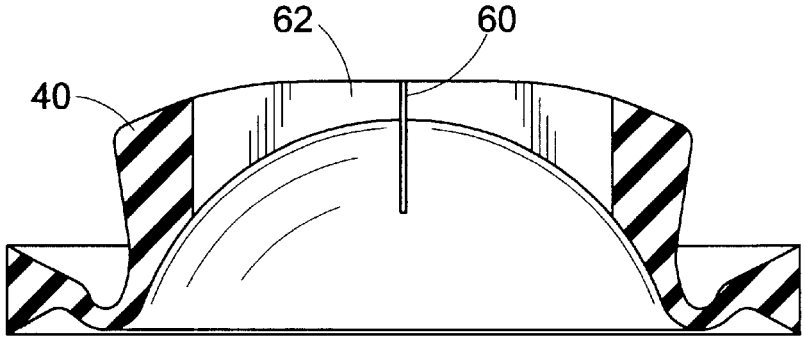
FIG. 7 is an enlarged side elevational view, in cross section, of the valve of the airflow indicator of FIG. 6.

Referring to FIGS. 6 and 7, the bleed valve 40 has cross slits 60, 62 which intersect one another in the shape of a cross and operate in a manner which is different than a wire form spring. The cross slits 60, 62 of the valve 40 seal in a resting or loaded state. Once a specified amount of vacuum pressure (approximately 56 inches of $H_2O$) is applied to the back side of the valve 40, the cross slits 60, 62 will displace and open up to a specified orifice size (i.e., ⅜ diameter) allowing for a desired amount of cooling (atmospheric) air to enter the chamber. The pressure within the indicator immediately drops. The valve 40 remains open until a specified pressure of approximately 42 inches of $H_2O$ is reached. Then, the valve re-seals. Thus, the valve is kept from staying open and reducing the vacuum cleaner's cleaning power unless it is functionally required. Furthermore, oscillation of the valve 40 can be prevented. In a vacuum system, the vacuum pressure drops immediately following the valve opening. This fact alone can cause a valve to oscillate if there is not an adequate hysteresis.

Figure 8:
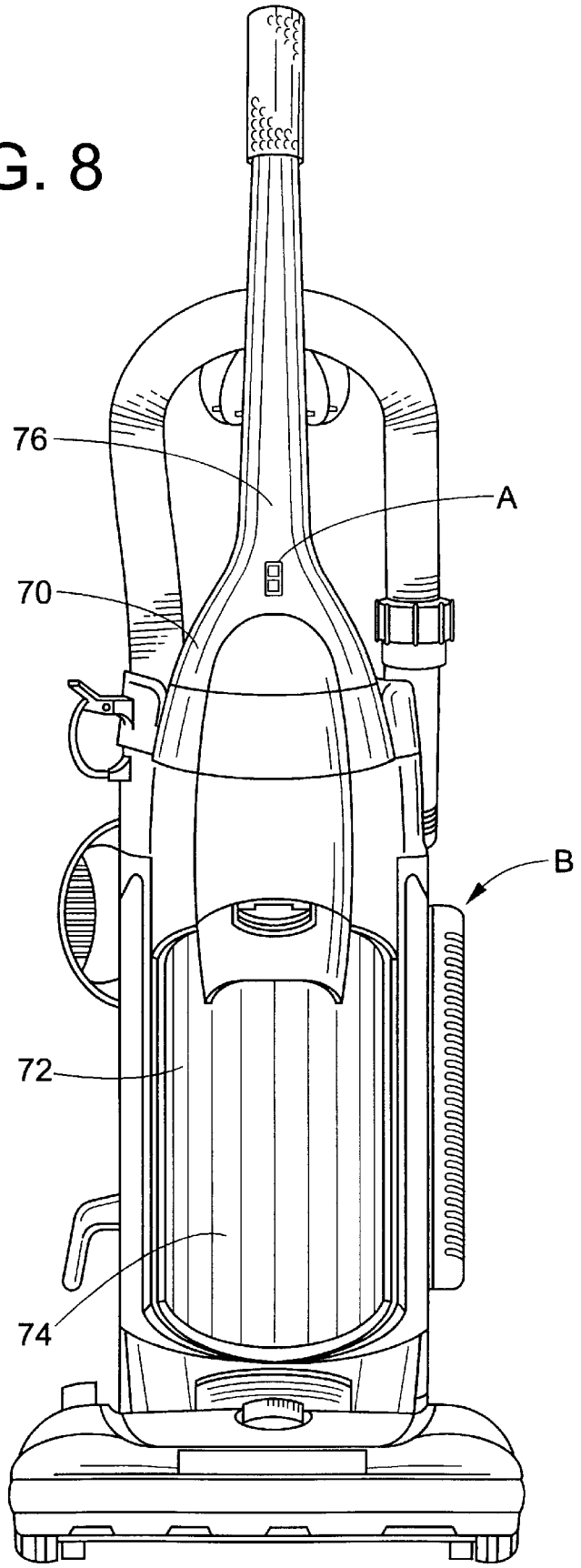
FIG. 8 is a front elevational view of a vacuum cleaner with an airflow indicator of FIG. 1.

Referring to FIG. 8, a vacuum cleaner B is shown which has a casing 70 through which the airflow indicator protrudes. The airflow indicator A is positioned behind and above the dirt cup 72 and the dirt cup filter 74. The airflow indicator A is positioned within the casing 70 near the base of the handle 76 portion and is welded into place. However, this device may be used on any vacuum cleaner or other airflow device that uses air flow during normal operation.

If desired, the bleed valve 40 can be used in a vacuum cleaner without the airflow indicator wheel 22 and window 24. The use of the bleed valve 40 eliminates providing a thermostat for the motor and provides a cost reduction for manufacturing the vacuum cleaner.

The invention has been described with reference to a preferred embodiment. Obviously, alterations and modifications will occur to others upon a reading and understanding of this specification. It is intended to include all such modifications and alterations insofar as they come within the scope of the appended claims or the equivalents thereof.

Having thus described the invention, it is claimed:

1. An airflow indicator for a vacuum cleaner, comprising:

a housing, said housing comprising a first end and a second end;

a wheel chamber defined at said first end of said housing;

a rotatable wheel mounted in said wheel chamber;

an air inlet formed adjacent said first end of said housing;

an air passageway formed within said housing adjacent said rotatable wheel and said air inlet;

a valve mounted within said housing adjacent said air passageway, wherein said valve comprises a cross slit which opens in response to a change in vacuum pressure within a casing of said vacuum cleaner; and an air outlet formed in said housing.

2. The airflow indicator of claim 1 further comprising a window portion which partially encloses said wheel chamber, wherein said window portion allows a viewing of said wheel from outside of said wheel chamber.

3. The airflow indicator of claim 1 wherein said cross slit remains closed at a pressure of less than about 56 inches of $H_{20}$.

4. The airflow indicator of claim 1 wherein said valve is fabricated from a material including silicon.

5. The airflow indicator of claim 1 wherein said wheel has protrusions which cause said wheel to rotate due to air flow entering said housing through said air inlet.

6. The airflow indicator of claim 5 wherein said wheel further comprises markings which gradually increase in size along an outside perimeter of said wheel, wherein said markings indicate movement of said wheel.

7. The airflow indicator of claim 5 wherein said air passageway is curved to facilitate air flow along said protrusions of said wheel.

8. The airflow indicator of claim 1 wherein said housing is comprised of a first section and a second section.

9. The airflow indicator of claim 1 wherein said housing is fabricated from a plastic material.

10. A bleed valve mechanism for a vacuum cleaner, comprising:

a housing, said housing comprising a first end and a second end;

an indicating device within said housing to indicate air flow; said device comprising a rotatable wheel a window portion on an outside surface of said housing for viewing said wheel;

an air inlet formed adjacent said first end of said housing;

an air passageway formed within said housing adjacent said air inlet;

a valve mounted within said housing adjacent said air passageway, wherein said valve comprises a cross slit which opens in response to a change in vacuum pressure within a filter chamber located in said vacuum cleaner; and an air outlet formed in said housing.

11. The bleed valve of claim 10 wherein said cross slit remains closed at a pressure of less than about 56 inches of $H_2O$.

12. The bleed valve of claim 10 wherein said housing is comprised of a first section and a second section.

13. The bleed valve of claim 10 wherein said housing is fabricated from a plastic material.

14. A vacuum cleaner comprising:

a casing including a suction motor and fan assembly;

a handle attached to said casing;

a dirt cup and filter mounted to said casing for collecting dirt and debris vacuumed from a surface to be cleaned; and, an airflow indicator mounted to said casing, said airflow indicator comprising:

a housing, a wheel chamber defined in said housing, a rotatable wheel mounted in said wheel chamber, an air inlet formed in said housing adjacent said rotatable wheel, an air passageway formed within said housing adjacent said rotatable wheel and said air inlet, a valve mounted within said housing adjacent said air passageway, wherein said valve comprises a cross slit which opens in response to a change in vacuum pressure within said casing, and an air outlet formed in said housing, wherein said air inlet is spaced from said air outlet.

15. The vacuum cleaner of claim 14 further comprising a window portion which partially encloses said wheel within said wheel chamber, wherein said window portion allows viewing of said wheel from outside of said wheel chamber.

16. The vacuum cleaner of claim 14 wherein said cross slit remains closed at a pressure of less than about 56 inches of $H_2O$.

17. The vacuum cleaner of claim 14 wherein said valve is fabricated from a resilient material.

18. The vacuum cleaner of claim 14 wherein said wheel has protrusions which cause said wheel to rotate due to air flow entering said housing through said air inlet.

19. The vacuum cleaner of claim 18 wherein said wheel further comprises markings which gradually increase in size along an outside perimeter of said wheel, wherein said markings visually indicate a movement of said wheel.

* * * * *